US010306918B2

(12) United States Patent
Sinclair, Jr.

(10) Patent No.: US 10,306,918 B2
(45) Date of Patent: Jun. 4, 2019

(54) METHOD AND APPARATUS FOR CONICAL FORM MANDREL CONSTRUCTED FROM CYLINDRICAL BLANK

(71) Applicant: Daniel S. Sinclair, Jr., Mandeville, LA (US)

(72) Inventor: Daniel S. Sinclair, Jr., Mandeville, LA (US)

(73) Assignee: Durfort Holdings, S.A., Panama (PA)

( * ) Notice: Subject to any disclaimer, the term of this patent is extended or adjusted under 35 U.S.C. 154(b) by 296 days.

(21) Appl. No.: 15/215,235

(22) Filed: Jul. 20, 2016

(65) Prior Publication Data

US 2017/0042218 A1 Feb. 16, 2017

Related U.S. Application Data

(60) Provisional application No. 62/195,182, filed on Jul. 21, 2015.

(51) Int. Cl.

| | |
|---|---|
| ***A24D 1/02*** | (2006.01) |
| ***A24C 3/00*** | (2006.01) |
| ***A24C 1/30*** | (2006.01) |
| ***A24D 1/04*** | (2006.01) |
| ***B65D 75/58*** | (2006.01) |
| ***B65D 85/10*** | (2006.01) |
| ***A24C 5/40*** | (2006.01) |
| ***A24F 17/00*** | (2006.01) |
| *A24C 1/00* | (2006.01) |

(52) U.S. Cl.

CPC ..... *A24D 1/022* (2013.01); *A24C 1/30* (2013.01); *A24C 3/00* (2013.01); *A24C 5/40* (2013.01); *A24D 1/045* (2013.01); *A24F 17/00* (2013.01); *B65D 75/5805* (2013.01); *B65D 85/1027* (2013.01); *A24C 1/00* (2013.01)

(58) Field of Classification Search

CPC ..... A24D 1/022; A24D 1/045; A24C 1/30; A24C 3/00; A24C 5/40; A24C 1/00; A24F 17/00; B65D 75/5805; B65D 85/1027

See application file for complete search history.

(56) References Cited

U.S. PATENT DOCUMENTS

2006/0037622 A1* 2/2006 Bachmann ..... A24C 5/46 131/347

* cited by examiner

*Primary Examiner* — Anthony Calandra
*Assistant Examiner* — Jamel M Nelson
(74) *Attorney, Agent, or Firm* — Brett A. North

(57) ABSTRACT

A product and method of making thereof for the consumption of smokable substances such as tobacco or herbs. The product is comprised of smokable substances such as smokable herbs, plants, tobacco, homogenized tobacco and/or natural leaf materials and has a hollow conical shape that allows for the easy insertion of smokable substances. Additionally, the conical or frustoconical shape of the product provides for larger amounts of smokable substances in the end of the product the consumer lights, resulting in an initial slower prolonged burn and more even distribution of nicotine. Additionally, placement of a supporting insert into the interior of the product supports the conical shaped of the product when packaged along with supporting during the process of being filled.

11 Claims, 12 Drawing Sheets

110
114
100
180
120

408
402
300
300
409
404

300
405
404
422
402
403
300

405
404
300
420
421
426
402

404
452
472
300
412
403
300
405
402
470
415
406

300
462
450
460
420
490
464
402
404
416
300
414

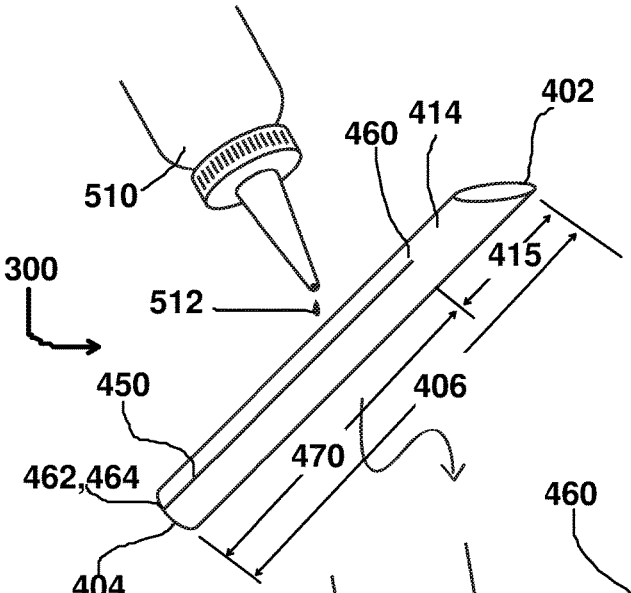
FIG. 3
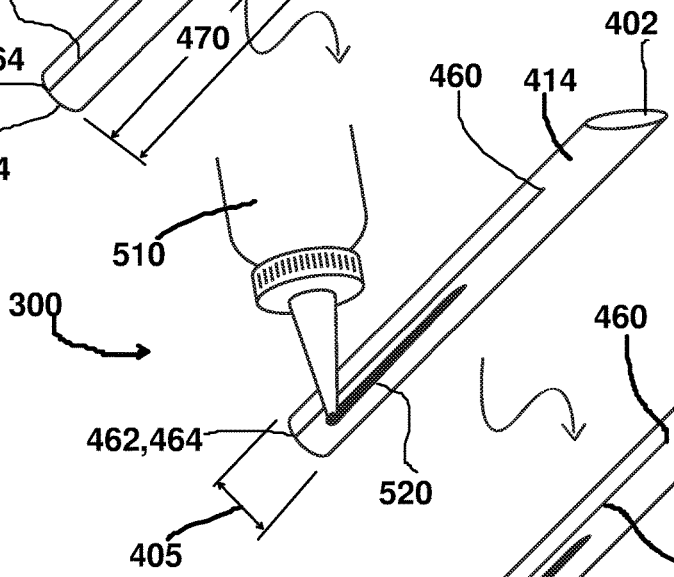
FIG. 4
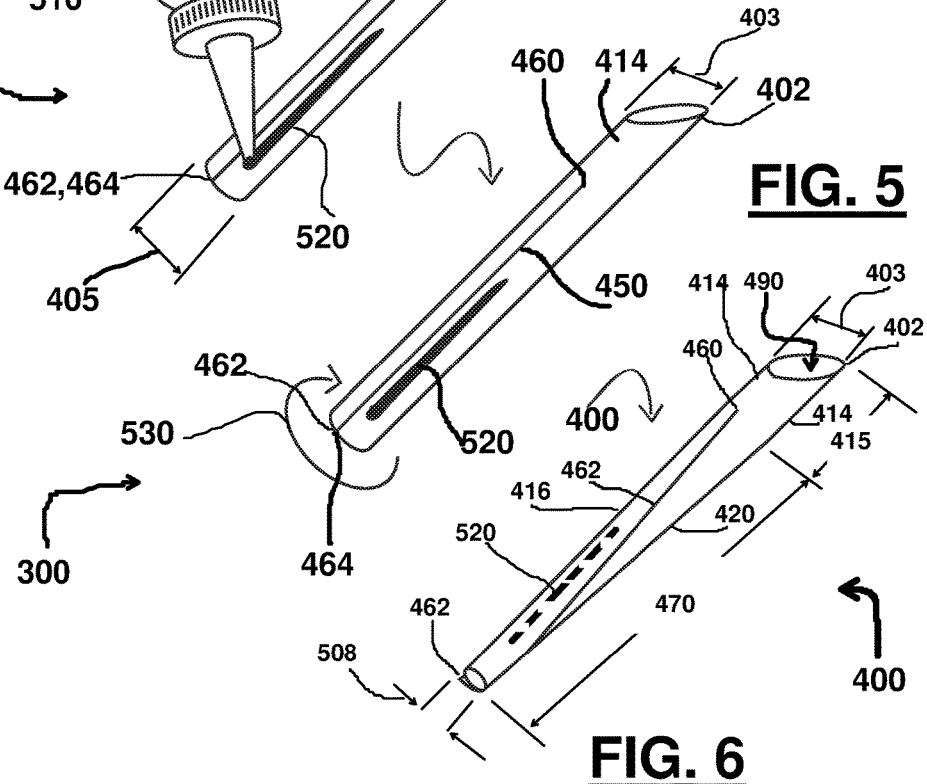
FIG. 5
FIG. 6

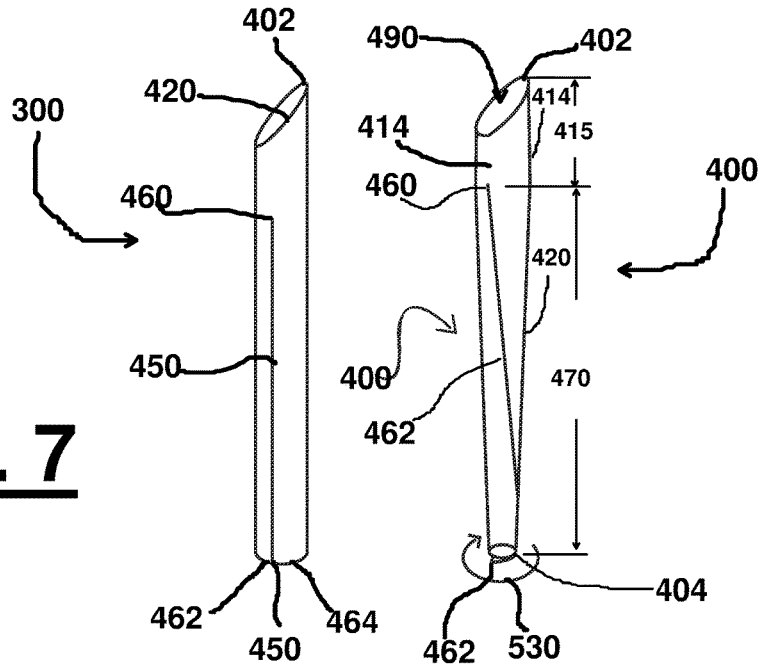
FIG. 7
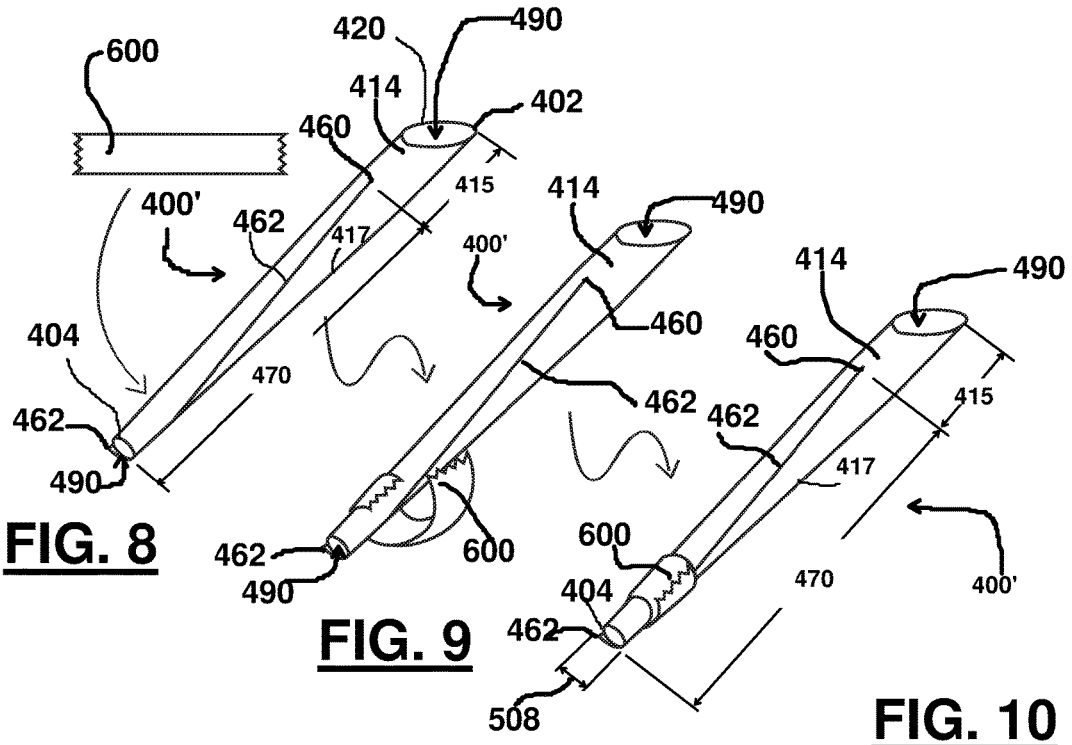
FIG. 8
FIG. 9
FIG. 10

1120
1122
490
420
400"
414
460
450
417"
100
110
130
114
1110
508'
180
120
117
1130
508"
114

1130
180 180

180

597
414
450
460
400
400"
417'''
110
532
130
508'''
404
114
1130
180

1142
1140
490
420
400"
598
414
460
530
450
460
417'''
540
508'''
110
130
1150
180

METHOD AND APPARATUS FOR CONICAL FORM MANDREL CONSTRUCTED FROM CYLINDRICAL BLANK

CROSS-REFERENCE TO RELATED APPLICATIONS

This application claims the benefit of U.S. provisional patent application Ser. No. 62/195,182, filed Jul. 21, 2015, which is incorporated herein by reference and priority of/to which is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

The present invention relates to smoking articles such as cones, cigarillos, and/or cigars. More particularly, the present invention relates to an improved cigar, cigar shell and method of making a smokable article wherein a conically or frustoconically shaped form of a shell with an interior and longitudinal centerline is preserved where the shell is packaged for sale in an unfilled state (with a reinforcing conical support) such as a foil pouch which the shell's conical or frustoconical shape is generally preserved in the packaging using a conical form mandrel which was constructed from a generally cylindrical starting blank; and wherein conical support can also be used to support the conical or frustoconical shaped of the cigar shell during filling, wherein during the filling process the smokable filler both passes through the interior of the support insert, and the support insert is longitudinally moved relative to the shell in a direction opposite of the direction that the smokable filler passes through the supporting insert and the end of the conical support enlarges as it is pulled out longitudinally from the shell.

Many cigar smokers prefer to use their own tobacco product as opposed to purchasing cigars that are already constructed and filled with tobacco. These users of fine, custom tobacco prefer to start with an empty shell which they prefer to purchase and then fill with their own custom tobacco filler material or other smokable material after the shell has been removed from its package.

Patents have issued for cigar products or smokable products that begin with an empty shell that is packaged in an empty or less than filled condition, thus enabling a smoker to later add his or her custom tobacco filler. For example, the Sinclair U.S. Pat. Nos. 6,321,755; 6,357,448; 6,526,986; and 7,717,119, each hereby incorporated herein by reference disclose tobacco shells that are packaged empty of contents so that a user can add his or her custom tobacco or other fill material to the shell after opening the package.

BRIEF SUMMARY

Various embodiments relate generally to products for the consumption smokable substances, and more particularly to a product and method of making thereof for the consumption of tobacco and other smokable substances having a hollow conical or frustoconical shape. A conically or frustoconically shaped form has an outer surface, a large diameter end, a small diameter end, and a cavity that extends to said small diameter end.

Various embodiments related generally to products and methods of making thereof, for consumption of tobacco, herbs and other similar smokable substances.

In one embodiment, both the sheet of smokable material and the form are packaged.

In one embodiment, the form and sheet of material are nested, wherein the sheet large section is wrapped around the form.

One embodiments provides a product that is easy to use and provides for a superior smoke.

The present invention may further comprise:

(a) a container for packaging the hollow cone, (b) whereby the cone will be protected and not lose its shape.

Additionally, the present invention may further comprise:

(a) an elongated member
for packing smokable substances
into the hollow cone.

One embodiment provides for a method of making a custom cigar for the consumption of tobacco and other smokable substances resulting in a product that is easy to construct, fill, and finish, and provides for a consistent quality smoke.

One embodiment provides for a method of making a custom cigar for the consumption of tobacco and other smokable fillers, wherein the number of steps required for the consumer to produce a final customized smokable product is reduced as compared to prior art methods.

One embodiment provides a kit for creating a product for smoking tobacco and other smokable substances, comprising:

(a) a first hollow cone having
a first hollow cone longitudinal axis,
a first end
defining a larger first cone opening perimeter with diameter, and
a second end
defining a smaller first cone opening perimeter with diameter,
whereby
the diameter of the larger first cone opening perimeter is greater than the
the diameter of the smaller first cone opening perimeter,
whereby
a line spanning between the larger and smaller first cone opening perimeters
has a first conical slope and length; and
a first cone interior,
the first cone interior being defined by a space between the larger first cone opening perimeter and the smaller first cone opening perimeter,
wherein, the first cone is comprised of smokable materials;

(b) a first conical support being constructed from a starting cylindrical blank, the starting cylindrical blank including:

(i) first and second ends, and a length between the first and circular second ends, (ii) a cylindrical wall spanning between the first and second circular ends having a longitudinal axis, (iii) the first and second circular ends respectively having initial first and initial second diameters, wherein the initial first diameter is substantially the same as the initial second diameter;

(iv) a separation in the cylindrical wall, the separation spanning from the first end to a separation end point between the first and second circular ends, which separation end point is located closer to the second circular end;

(v) wherein the separation is used to reduce the size of the diameter of the first circular end compared to the diameter of the second circular end;

(vi) wherein the reduction of the diameter of the first circular end a line spanning between the first circular end and the end point to have a first support slope and length;

(c) the first conical support being placed into the first cone interior, wherein the first conical slope is about the same as the first support slope, and the first conical support tending to maintain the first hollow cone in a conical shape; and (d) the first cone with the supporting first conical support being packaged for sale with the interior of the first cone not being filled with a smokable filler material.

In one embodiment the first conical slope is changeable based on the extent to which the first conical support is nested inside the first cone.

In one embodiment the first conical slope is decreases as the nested first conical support is pulled out of the first cone.

In one embodiment the cone includes a first filter tip at the second end of the first cone.

In one embodiment the first cone and first conical support are nested condition inside a package.

In one embodiment the package is a bag, pouch, and/or flexible wrapper.

In one embodiment the package is rectangularly shaped, conically shaped, and/or generally cylindrically shaped.

In one embodiment is provided a packaged cigar apparatus that generates a smokable article, comprising:

a) a package having an interior and an end portion with a sealed opening;

b) first shell being a hollow conically shaped smokable shell with a shell interior and a shell slope or taper;

c) a reinforcing conical support that is able to occupy a position within the shell interior of the shell, the reinforcing conical support having a stiffness that is greater than the stiffness of the shell, and the reinforcing conical support being constructed from a cylindrical blank having a cylindrical wall and hollow interior along with a partial slit in the cylindrical wall from one end of the blank but not extending to the second end of the blank forming slit edges, and with the slit edges being overlapped to provide a conical shape having a reinforcing slope or taper to at least fifty percent of the longitudinal length of the reinforcing conical support, and the reinforcing conical support having a hollow cone shaped cone interior;

d) wherein the shell and reinforcing conical support are packaged inside the package interior as an assembly with the reinforcing conical support occupying the shell interior.

In one embodiment the reinforcing slope is substantially equal to the slope or taper of the shell.

In one embodiment the reinforcing slope is greater than the slope or taper of the shell.

In one embodiment is provided a method of constructing a smokable product, comprising the steps of:

a) providing a package having an interior and an end portion with a sealed opening;

b) providing a shell having a shell wall and hollow conically shaped shell interior;

c) placing a reinforcing conical support within the shell interior, the reinforcing conical support having upper and lower open ends, wherein the lower open end tries to expand while inside the hollow conically shaped interior;

d) packaging the shell with the reinforcing cone occupying the hollow shell interior, and the shell and reinforcing cone being located inside the package as an assembly wherein the tendency of the lower open end of the reinforcing conical support to expand causes a tensile force to be created in the shell wall;

e) enabling the construction of a smokable product by a removal of the shell and reinforcing cone so that a user can fill the shell with his or her selected smokable material using a push rod to compact smokable material that is placed within a the shell; and f) wherein the reinforcing conical support is configured to support the shell during step "e", while allowing smokable material to travel from the reinforcing conical support to the shell via the lower opening, and while simultaneously allowing the lower opening of the conical support to enlarge as the conical support is pulled up from the shell.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIGS. 3 and 4 are schematic views showing application of an adhesive on the now cut cylindrical blank.

FIGS. 5 through 7 are schematic views showing the twisting of the new cut cylindrical blank to create a cylindrical form mandrel, where the cylindrical shape of the form mandrel is maintained by the previously applied adhesive.

FIGS. 8 through 10 are schematic views showing the cylindrical shape of the form mandrel being maintained by an externally applied adhesive strip, such as tape.

DETAILED DESCRIPTION OF THE INVENTION

Smokable article kit includes first 100 and second 1000 cones with conical form mandrel 400 packaged for sale in a flexible packaging 800 (such as a foil pouch) when not filled with smokable filler material.

Figures 1, 2A, 2B, 2C, 2D, 2E:
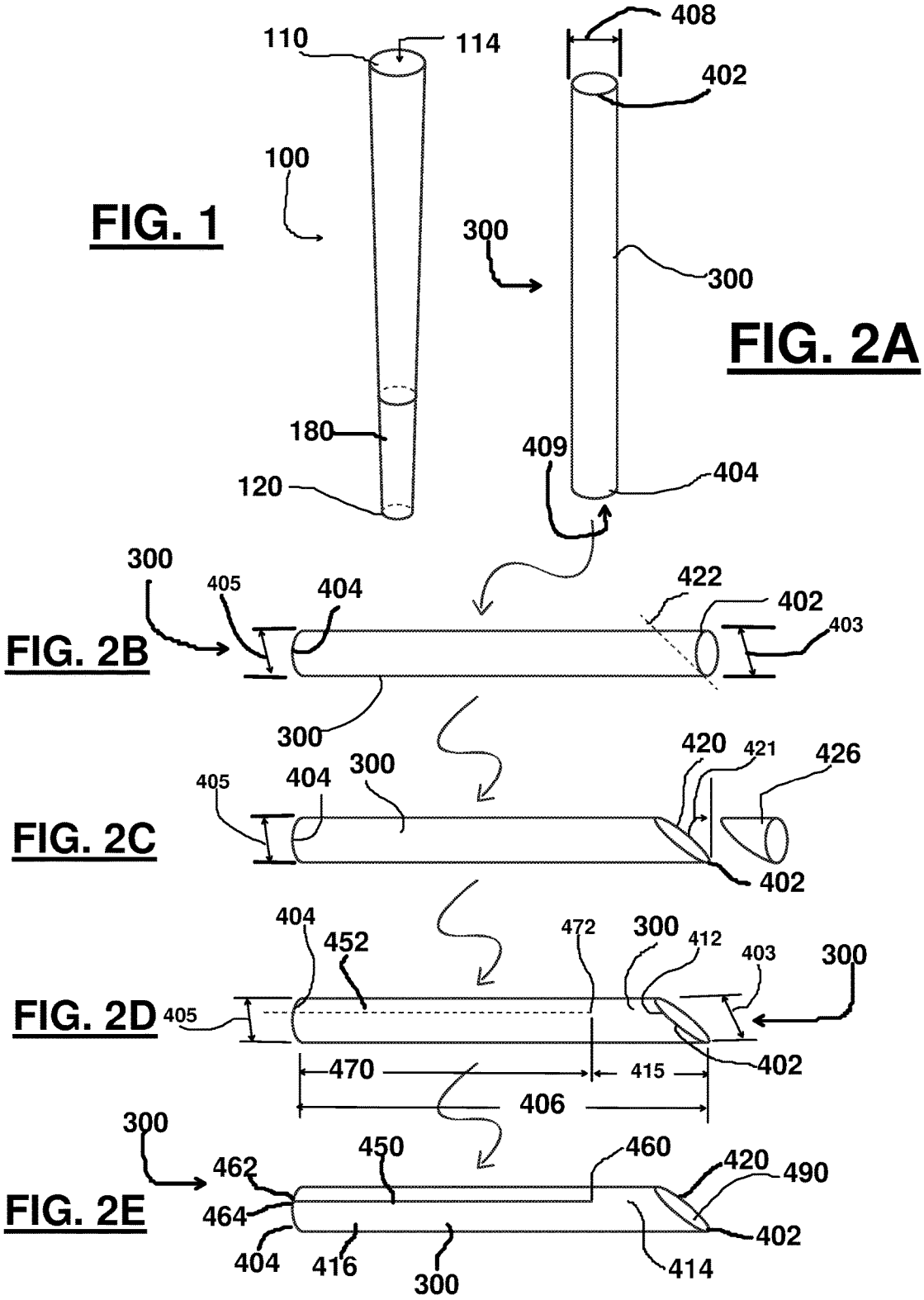
FIG. 1 is a perspective view of a cone adjacent to a cylindrical blank.
FIGS. 2A, 2B, 2C, 2D, and 2E are schematic views showing two cuts for converting the cylindrical blank into a conical form mandrel.

FIG. 1 is a perspective view of a smokable cone 100 adjacent to a cylindrical blank 300 (cone 100 can be constructed by conventional methods).

First cone 100 can include first end 110, second end 120, outer surface 140, and filter tip 180. At first end 110 can be first opening 150. At second end 120 can be second opening 160. First opening 150 can be larger than second opening 160 giving first cone 100 its conical shape. Between first end 110 and second end 120 is interior portion 114 which includes inner surface 130.

In various embodiments a second cone 1000, constructed substantially the same as first cone 100, can be provided. Second cone 1000 can include first end 1010, second end 1020, outer surface 1040, and filter tip 1080. At first end 1010 can be first opening 1050. At second end 1020 can be second opening 1060. First opening 1050 can be larger than second opening 1060 giving second cone 1000 its conical shape. Between first end 1010 and second end 1020 is interior portion 1014 which includes inner surface 1030.

Conical form mandrel 400 can be used to maintain the conical shape of first 100 and/or second cones 1000. In various embodiments novel methods of construction and novel conical form mandrels can be provided.

FIGS. 2A through 2E includes various schematic views showing two cuts for converting the cylindrical blank 300 into a conical form mandrel 400. Cylindrical blank 300 can include first end 402 and second end 404 a diameter 408. First end 402 can have a diameter 403 and second end can have a diameter 405 where initially diameter 403, diameter 405 and diameter 408 are substantially equal. FIG. 2B schematically shows an angle of taper 422 at first end to be cut from cylindrical blank FIG. 2C shows the cut having been made creating a removed portion 426 (which can be discarded) and leaving a tapered section 420 at first end 402, wherein the tapered section 420 can have an angle of taper 421. In various embodiments the angle of taper 421 can be at least 5 degrees. In various embodiments the angle of taper 421 of tapered section 420 can be at least 5, 10, 15, 20, 25, 30, 33, 35, 40, 45, 50, and 60 degrees. In various embodiments the angle of taper 421 can fall within a range of any two of the above specified degree angles of taper 421 for tapered section 420.

FIGS. 2D and 2E show cut 452. In various embodiments cut 452 can have a length 470 which is at least 40 percent of length 406 of cylindrical blank 300/conical form mandrel 400. In various embodiments the length of cut 452 can be at least 45, 50, 55, 60, 65, 70, 75, 80, 85, 90, 92, 94, 95, 96, 98, and 99 percent of length 406.

In various embodiments the length of cut 452 can fall within a range of any two of the above specified percentages of length 406. In various embodiments cut 452 does not extend the entire length 406 of cylindrical blank 300/conical form mandrel 400 leaving an length 415 of non-cut portion of form mandrel. At second end 404 cut 452 has created a slit or separation 450 in the cylindrical wall of blank 300, and this slit or separation 450 includes opposing first edge 462 and second edge 464 along with end point 460 of slit or separation 450.

In various embodiments cut 452 can be located so that a line extending from cut 452 would intersect the lowest point of tapered section 420.

FIGS. 3 through 6 schematically show one embodiment of a method of preparing a cylindrical form mandrel 400 after cut 452 has been made in cylindrical blank 300. FIGS. 3 and 4 are schematic views showing application of an adhesive 520 on the now cut cylindrical blank 300. Overall length 406 is made up of length of slit 470 plus length 415 of upper portion 414.

FIGS. 5 through 7 are schematic views showing the twisting (schematically indicated by arrow 462) of the now cut cylindrical blank 300 to create a cylindrical form mandrel 400, where the cylindrical shape of the form mandrel 400 is maintained by the previously applied adhesive 520. In various embodiments showing the twisting (schematically indicated by arrow 462) of second end 404 causing first 462 and second 464 edges to overlap (FIG. 5 shows first edge 462 sliding on top of second edge 464) creating both a reduced diameter 508 at second end 404, along with a sloped portion 417 having length 470. In various embodiments reduced diameter 508 can be less than 80 percent of original diameter 405. In various embodiments reduced diameter 508 can be less than 80, 75, 70, 60, 55, 50, 45, 40, 35, 33, 30, 25, 20, 15, 10, and 5 percent of original diameter 405. In various embodiments reduced diameter 508 can fall within a range of any two of the above specified percentages of original diameter 405.

FIG. 5 shows first edge 462 sliding on top of second edge 464, but is envisioned that second edge 464 can be slid on top of first edge 462. Although not shown, it is envisioned that a triangular area could be cut from second end 404 (base of triangle) to end point 460 (tip of triangle) thereby creating first 462 and second 464 edges as the legs of the triangle and an open area at second end 404 as the base of the triangle—thereafter first 462 and second 464 edges being brought together and attached to form an alternative reduced diameter 508' and alternative sloped portion 417' (compared to the reduced diameter 508 and sloped portion 417 formed by overlapping first 462 and second 464 edges from a straight cut 450).

In various embodiments the slope of sloped portion 417 can be calculated by the formula:

slope=(diameter 405−diameter 508)/(2*length 470)

In various embodiments upper portion 414 can remain substantially unimpacted by creating reduced diameter 508 and therefore would not be sloped and/or "tapered" and would accordingly have a slope of zero.

FIGS. 6 and 7 show the final conical support 400 with adhesive 520 holding in place overlapped first 462 and second 464 edges to form sloped portion 417. FIG. 7 shows a side by side comparison of the cut 450 cylindrical blank 300 and the conical form mandrel 400 formed from the cylindrical blank 300.

FIGS. 8 through 10 are schematic views showing the cylindrical shape of the form mandrel being 400 maintained by an externally applied adhesive strip 600, such as tape.

Figures 11, 12, 13, 14, 15:
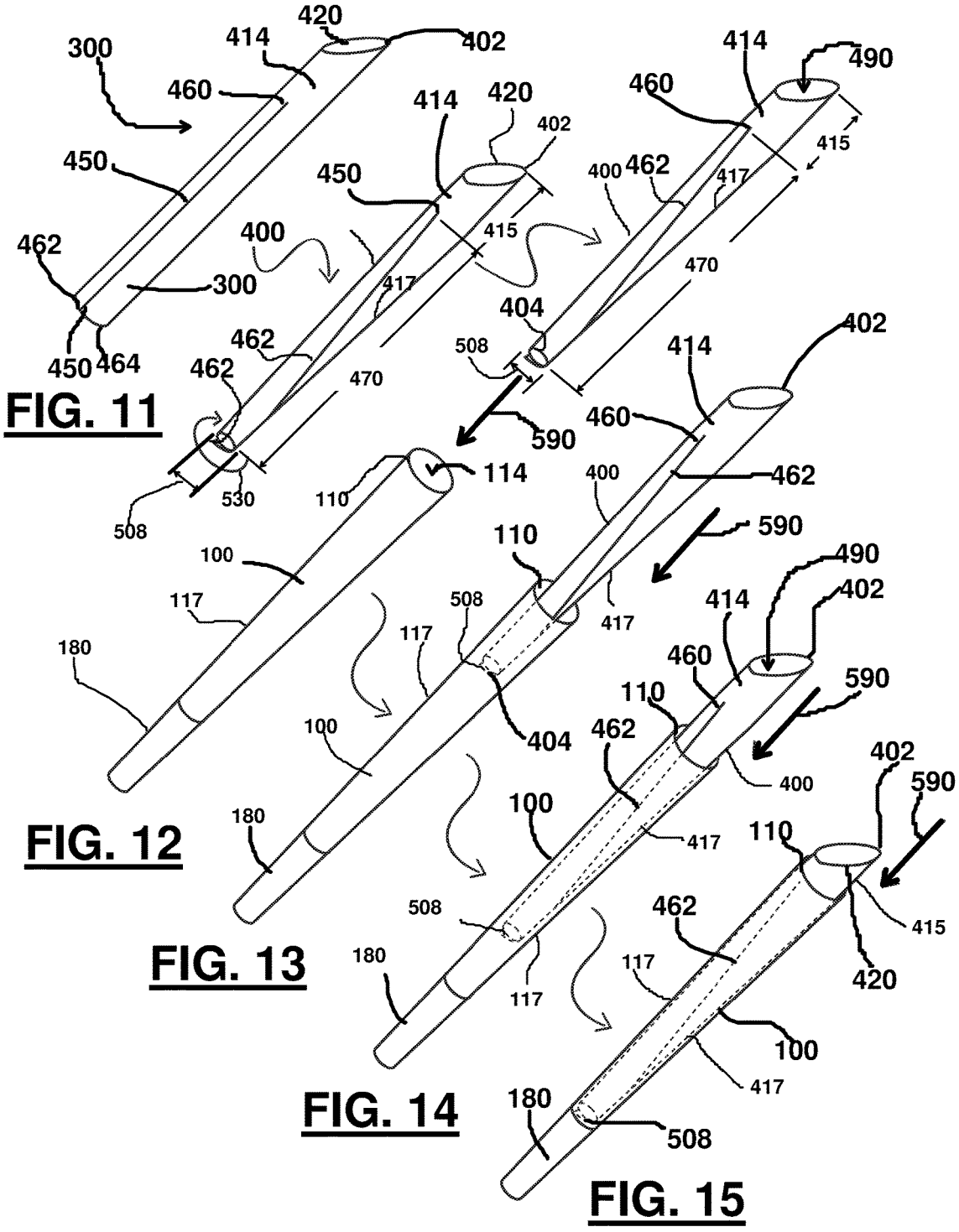
FIGS. 11 through 15 are perspective views schematically showing the created conically shaped form mandrel being inserted into a first cone.

FIG. 11 includes perspective views the slitted cylindrical blank 300, and the constructed conically shaped form mandrel 400. Conical form mandrel 400 can be constructed substantially the same as conical form mandrel 400 described in reference to FIGS. 1 through 7. FIGS. 12 through 15 are perspective views showing the conical form mandrel 400 being inserted into first cone 100.

In FIG. 15 conical form mandrel 400 is completely inserted into cone 100 where slope of sloped section 417 can be substantially equal to the slope 117 of cone 100 and conical form mandrel 400 can provide support from crushing of cone 100 to allow cone 100 to maintain its conical shape.

In various embodiments slope 417 can be greater than slope 117. In various embodiments slope 417 can be at least 1 percent greater than slope 117. In various embodiments slope 417 can be at least 1, 2, 3, 4, 5, 6, 7, 8, 9, 10, 15, 20, 25, 30, 33, and 35 percent greater than slope 117. In various embodiments slope 417 can fall within a range of any two of the above specified percentages of being greater than slope 117.

In various embodiments slope 417 can be smaller than slope 117. In various embodiments slope 417 can be at least 1 percent smaller than slope 117. In various embodiments slope 417 can be at least 1, 2, 3, 4, 5, 6, 7, 8, 9, 10, 15, 20, 25, 30, 33, and 35 percent smaller than slope 117. In various embodiments slope 417 can fall within a range of any two of the above specified percentages of being smaller than slope 117.

Figures 16, 17, 18:
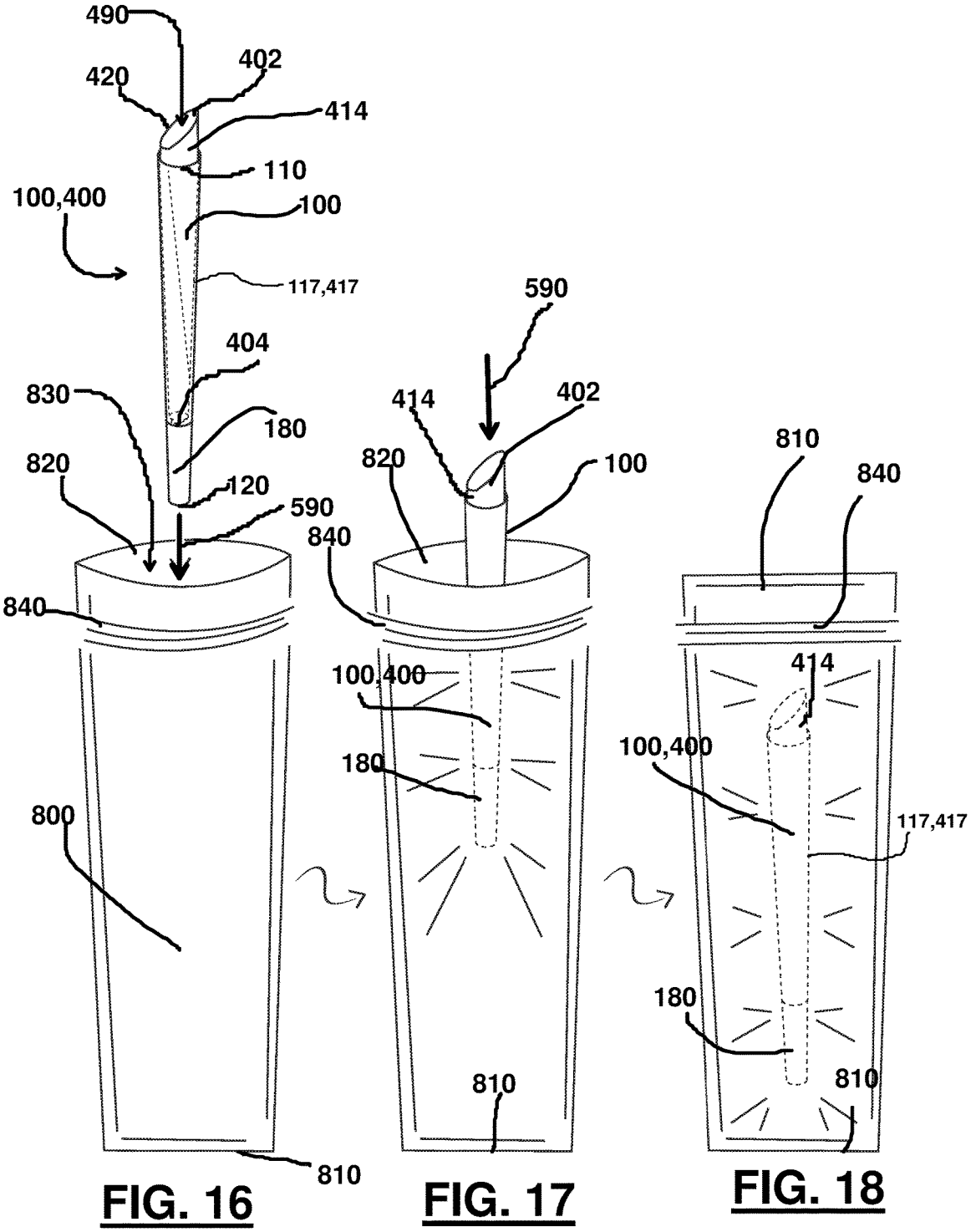
FIGS. 16 through 18 are perspective views of the first cone with conical form mandrel being inserted into a packaging pouch which packaging pouch is now sealed.

FIGS. 16 through 18 are perspective views showing the conical form mandrel 400 and first cone 100 being packaged in a wrapper such as a resealable foil pouch 800. After being fully inserted into pouch 800, pouch 800 can be sealed such as by sealing member 840. In FIG. 18 cone 100 with nested conical form mandrel 400 are completely inserted into pouch 800 where slope of sloped section 417 can be substantially equal to the slope 117 of cone 100 and conical form mandrel 400 can provide support from crushing of cone 100 to allow cone 100 to maintain its conical shape while inside of pouch 800.

Figures 19, 20, 21:
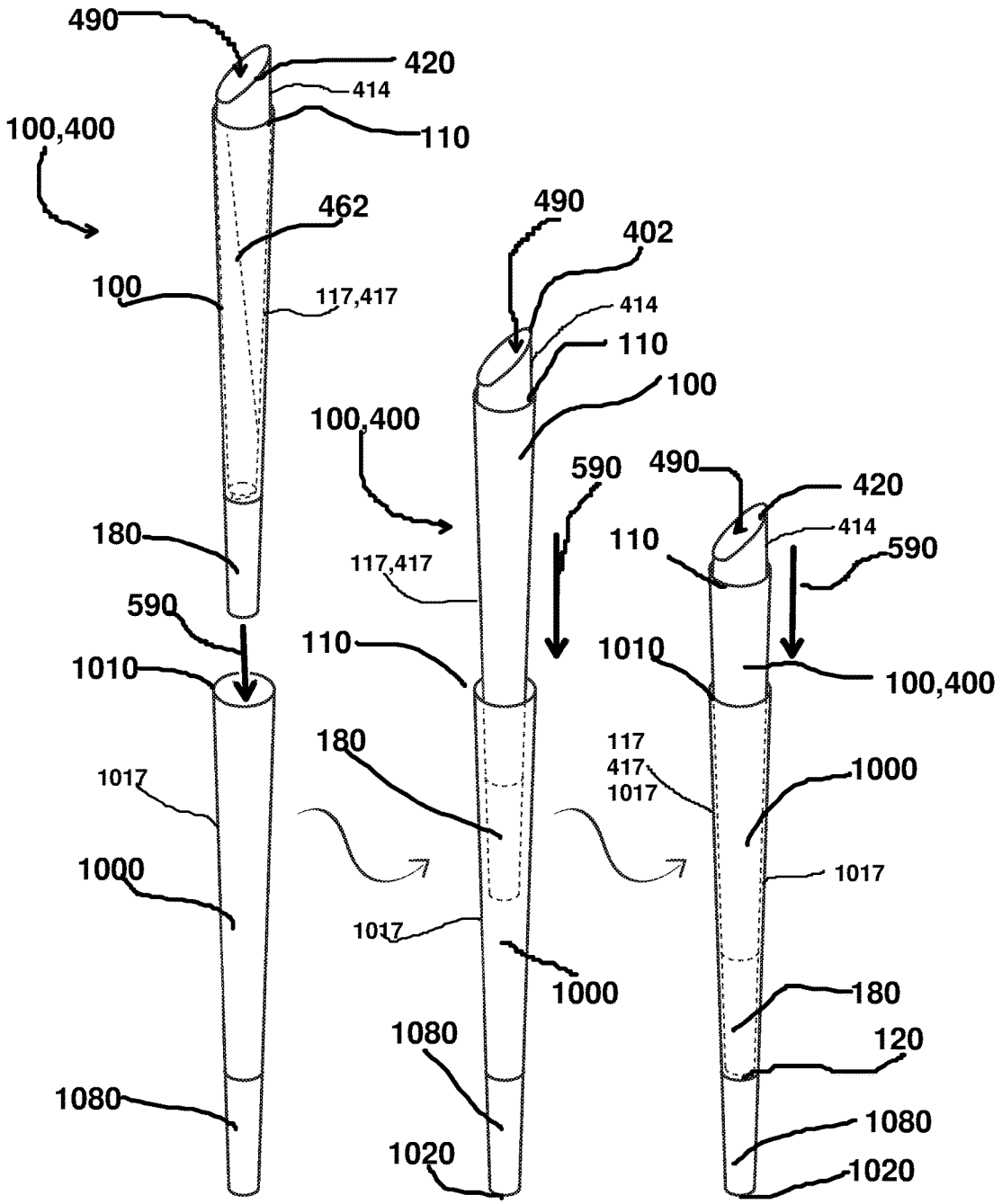
FIGS. 19 through 21 are perspective views of the first cone with conical form mandrel being nested into a second cone.

FIGS. 19 through 21 are perspective views of two nested cones 100,1000 with nested supporting conical form mandrel 400. FIG. 19 is a perspective view of the first cone 100 with inserted conical form mandrel 400 about to be inserted into a second cone 1000 (schematically indicated by arrow 590). FIG. 20 is a perspective view of the first cone 100 with inserted conical form mandrel 400 now partially inserted into second cone 1000 (schematically indicated by arrow 590). FIG. 21 is a perspective view of the first cone 100 (with inserted conical form mandrel 400) now fully inserted into second cone 1000. In this configuration, conical form mandrel 400 supports the conical shape of both first 100 and second 1000 cones.

Figures 22, 23, 24:
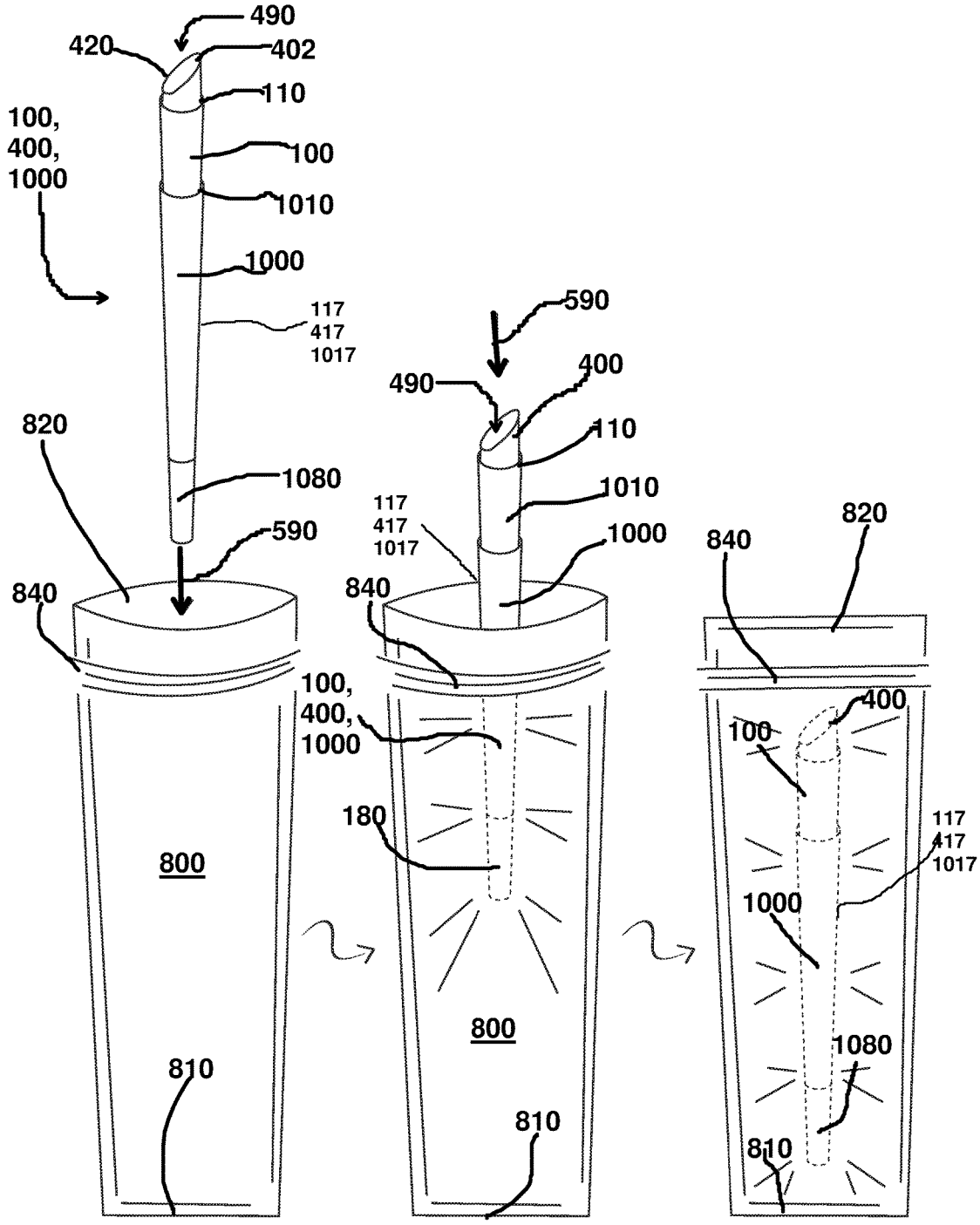
FIGS. 22 through 24 are perspective views of the first cone with conical form mandrel nested in a second cone, and the combination being inserted into a packaging pouch packaging pouch is now sealed.

FIGS. 22 through 24 are perspective views showing the combination nested conical form mandrel 400, first cone 100, and second cone 1000 being packaged in a wrapper such as a resealable foil pouch 800. After being fully inserted into pouch 800, pouch 800 can be sealed such as by sealing member 840. In this configuration, conical form mandrel 400 supports the conical shape of both first 100 and second 1000 cones to allow cones 100 and 1000 to maintain their conical shape while inside of pouch 800.

The support of conical support 400 resists the flattening out of the conical shape of first 100 and second 1000 cones when these cones are packaged in a flexible packaging 800. FIGS. 22 and 23 are perspective views of the first 100 and second 1000 cones being partially inserted into a sealable packing pouch 800 (schematically indicated by arrow 590). FIG. 24 is a perspective view of the first 100 and second 200 cones fully inserted into the packaging pouch 800 (show in dashed lines) which packaging pouch 800 is now sealed.

Packaging pouch 800 with first 100 and second 1100 cones nested with conical form mandrel 400 can be offered for sale, such as in retail outlets to consumers who desire to make customized smokable products. The customer would purchase pouch 800 with first 100 and second 1000 cones and then use the first 100 and second 1000 cones along with possibly conical form mandrel 400 to make a one or more customized cigars or other customized smoking products by adding a smokable filler of the user's choice.

Figure 25:
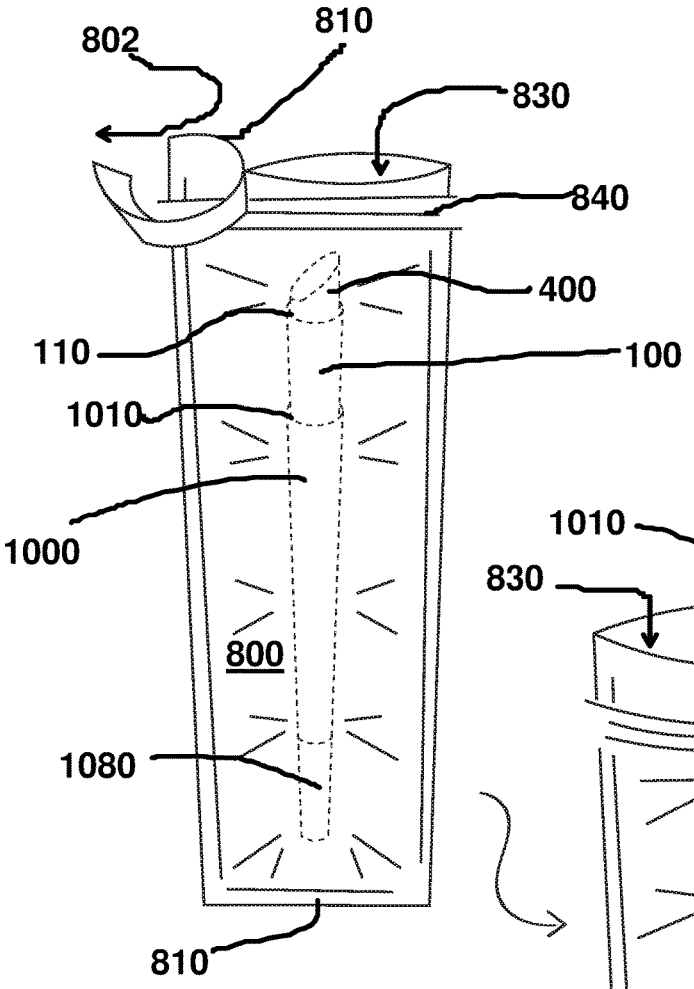
FIG. 25 is a perspective view of the packaging pouch of FIG. 24 now being opened.
Figure 26:
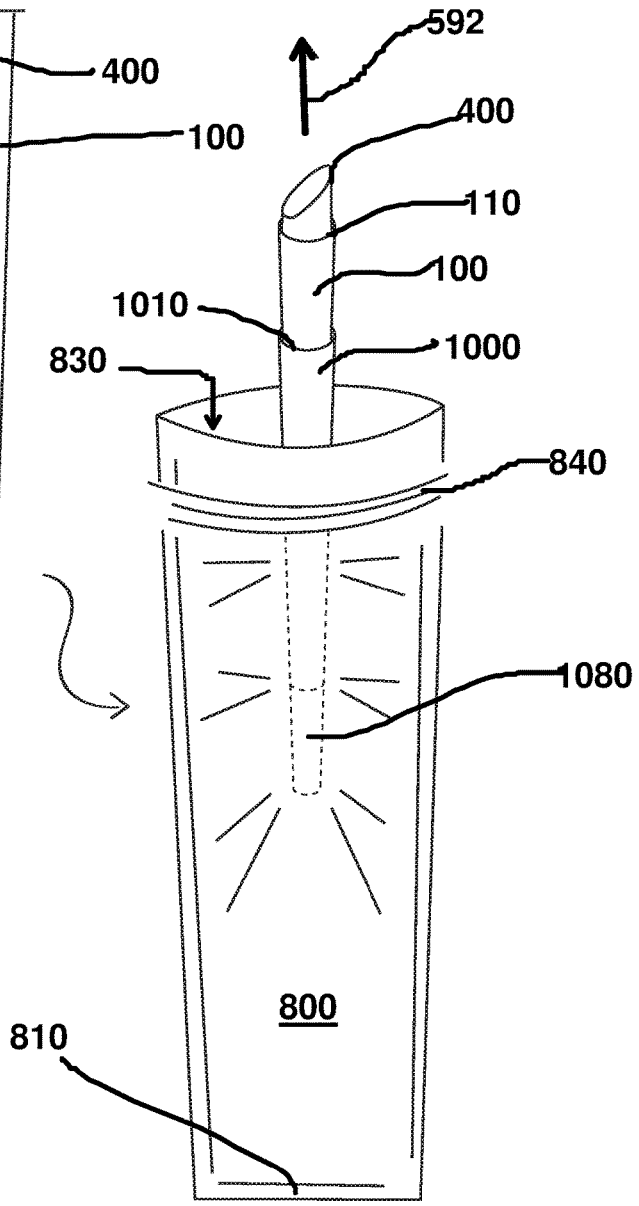
FIG. 26 is a perspective view of the first and second cones being partially removed from the opened packaging pouch of FIG. 25.
Figures 27, 28, 29:
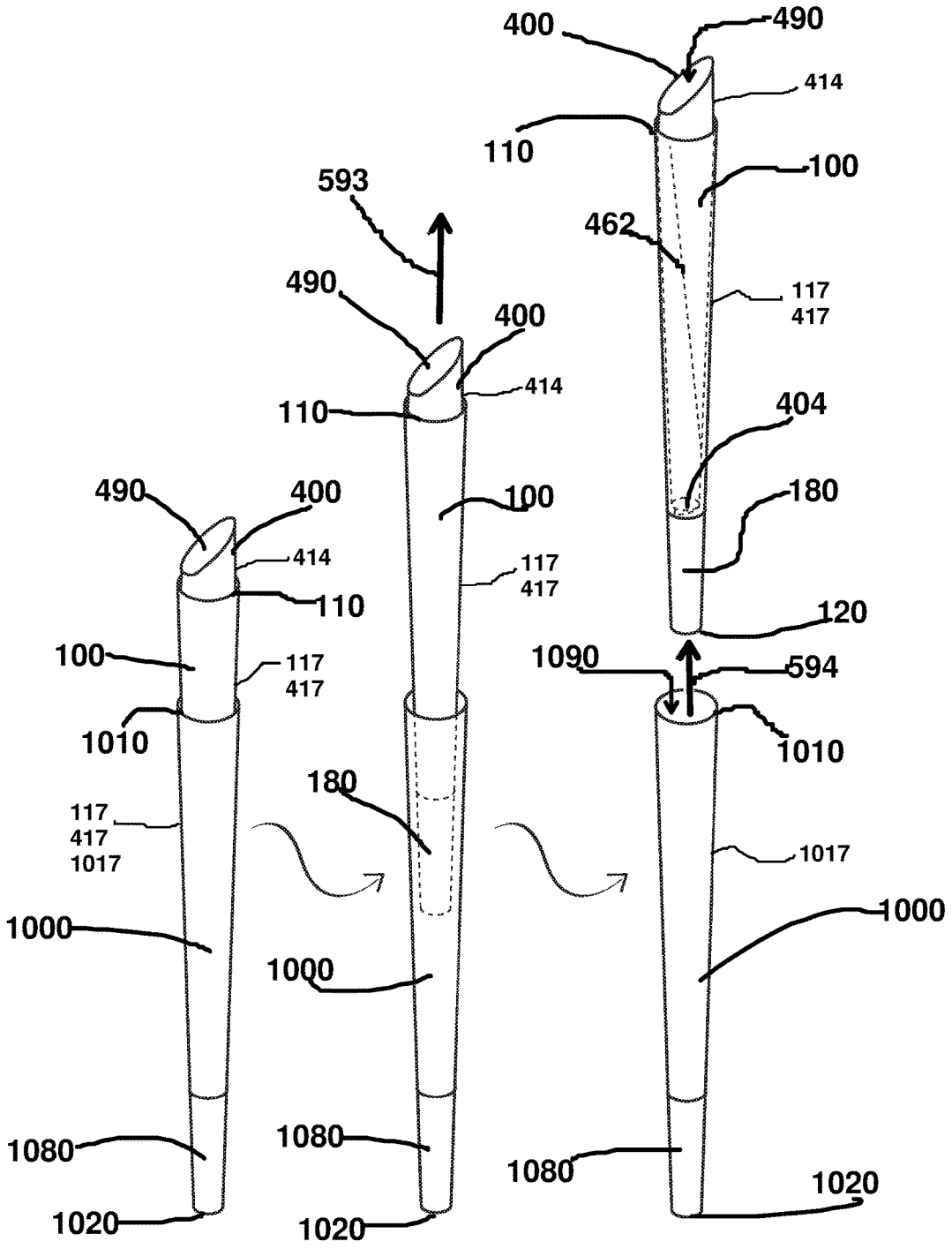
FIGS. 27 through 29 are perspective views of the now removed first and second cones, showing the removal of the first cone with conical form mandrel from the second cone. The second cone can be reinserted into the pouch of FIG. 25 with the pouch resealed.

FIGS. 25 and 26 show the opening of pouch 800 and removal of at least one of the cones 100,1000. FIG. 25 is a perspective view of the packaging pouch 800 now being opened (schematically indicated by arrow 802). FIG. 26 is a perspective view of the first and second cones 100,1000 being partially removed from the opened packaging pouch 800 (schematically indicated by arrows 592). FIGS. 27 through 29 schematically show the steps of, after removal from pouch 800, separating the nested first cone 100 from second cone 1000. FIGS. 27 through 29 are perspective views showing first 100 and second 1000 cones being separated from each other (schematically indicated by arrows 593 and 594). Once the first 100 and second 1000 cones are separated the second cone 1000 can be placed back in pouch 800 (with alternative conical form mandrel 400" with reconstructed smaller diameter 508 for create a conical shape), and pouch 800 is resealed to prevent drying out of second cone 1000.

Expanding Conical Form Mandrel

One embodiment of the steps for creating a customized smokable product with the first 100 and second 1000 cones with an alternative cylindrical form mandrel 400" will now be described. Alternative expanding conical form mandrel 400" can be constructed substantially the same as conical form mandrel 400 described in reference to FIGS. 1 through 7, except omitting any adhesives (e.g., adhesive 520 and/or adhesive strip 600) so that smaller diameter 508 of second end 404 will tend to want to expand back to its original diameter 405 and thereby "expand".

FIGS. 30 through 42 illustrate the steps in one embodiment of using a cone 100 and alternative "expanding" conical form mandrel 400" used to create a customized smokable product 1250.

As will be seen in FIGS. 30 through 42, smaller diameter 508 (at second end 404 of expanding conical form mandrel 400") will tend to enlarge until expansion is limited by inner surface 130 of cone 100. As smaller diameter 508 expands to diameter 508' and diameter 508" the slope of sloped portion 417 of expanding conical form mandrel 400" will decrease ultimately becoming zero when diameter 508 is no longer constrained in its enlargement by inner surface 130 of cone 100.

Figures 30, 31, 32, 33, 34:
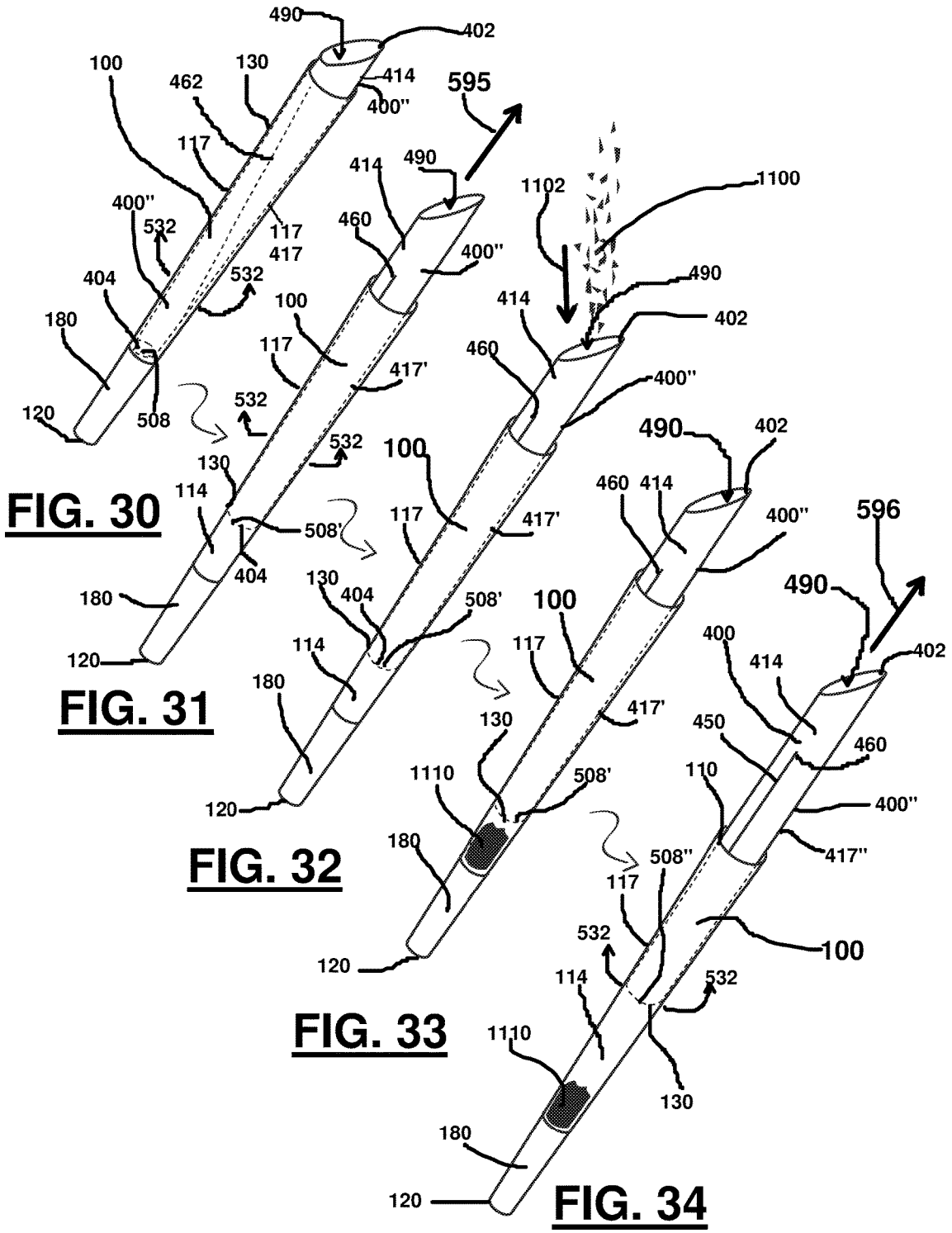
FIG. 30 is a perspective view of the first cone with conical form mandrel.
FIG. 31 is a perspective view of the first cone with conical form mandrel schematically showing the conical form mandrel being move longitudinally relative to the first cone.
FIG. 32 is a perspective view of the conical form mandrel, while remaining partially inserted in the first cone, being filled with smokable filler.
FIG. 33 is a perspective view showing the added smokable filler having passed through the conical form mandrel and resting at the bottom of the interior of the first cone.
FIG. 34 is a perspective view showing the added smokable filler remaining at the bottom of the interior of the first cone, while the conical form mandrel is schematically shown as being moved longitudinally relative to the first cone to provide additional interior volume in the first cone for additional smokable filler to be added.

FIG. 30 is a perspective view of the first cone 100 with expanding conical form mandrel 400" nested therein.

FIG. 31 is a perspective view of expanding conical form mandrel 400" being partially pulled up from the first cone 100 (partial removal is schematically indicated by arrow 595 and enlarges the amount of interior volume 114 that can be filled with smokable filler below the second end 404 of expanding conical form mandrel 400 along with allowing smaller diameter 508 to expand to diameter 508' where expansion of diameter 508' is limited by inner surface 130 of cone 100, but at the location shown in FIG. 31 the inner surface 130 is actually spaced farther apart than the inner surface 130 shown in FIG. 30). The pulling up in the direction of arrow 595 of expanding conical form mandrel 400" allows for tamped smokable filler to accumulate in the interior 114 of first cone 100. On the other hand, if expanding conical form mandrel 400" was filled with smokable filler and merely pulled out of first cone 100 it is expected that the smokable filler would also be pulled out of first cone 100 when conical form mandrel 400" is pulled out.

FIG. 32 is a perspective view of the first cone 100 with expanding conical form mandrel 400" being filled with smokable filler 1100 (schematically indicated by arrow 1102). Such smokable filler 1100 will slide down the interior 414 of expanding conical form mandrel 400" towards second end 404. However, at least some of the filler is expected to be partially blocked at second end 404 and must be tamped through. For this operation a tamping device can be used. FIG. 33 is a perspective view showing the added smokable filler 1110 having passed through the expanding conical form mandrel 400" and resting at the bottom of the interior 114 of the first cone 100.

Figures 35, 36, 37, 38, 39:
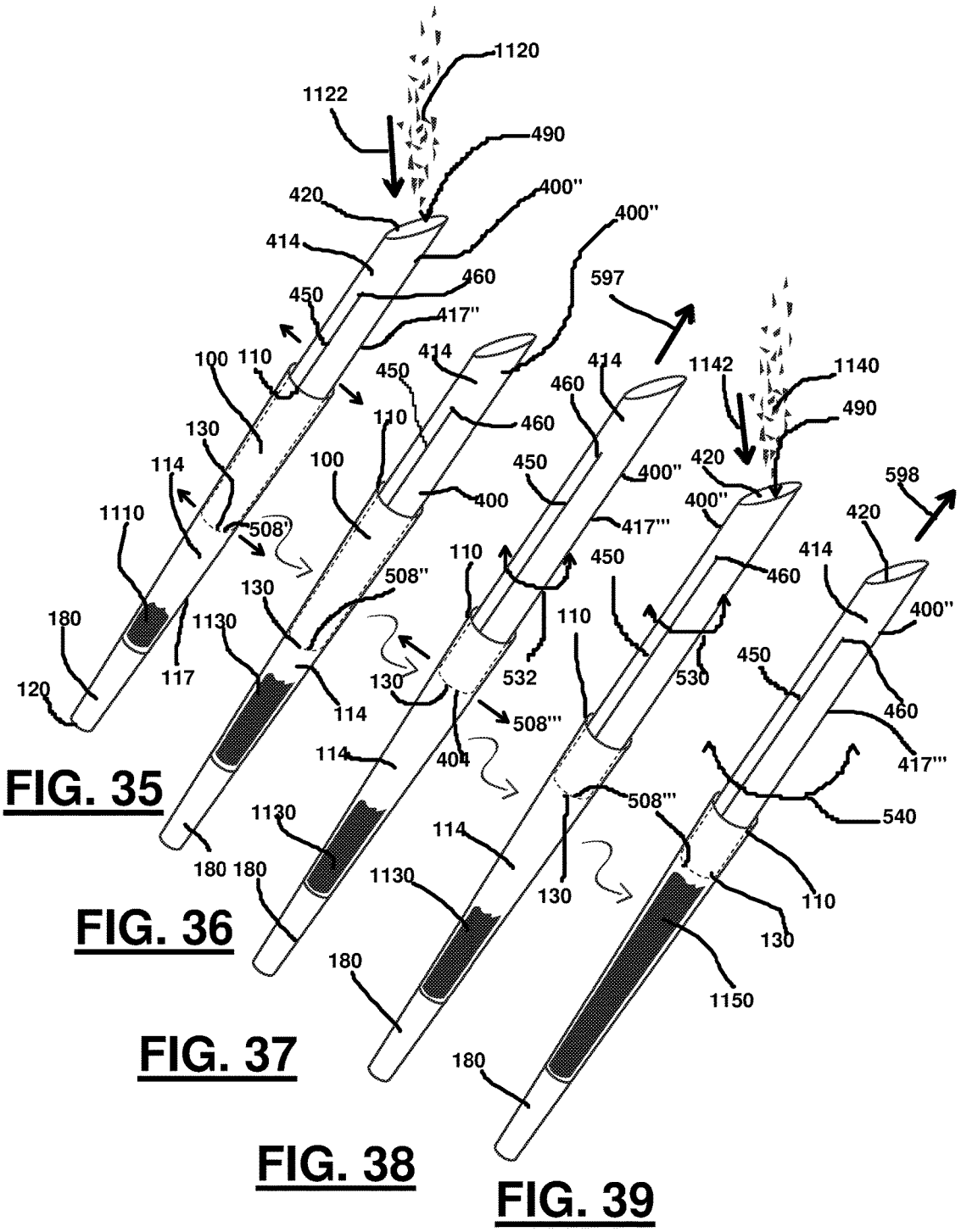
FIG. 35 is another perspective view of the first cone with conical form mandrel being filled with additional smokable filler from that added in FIG. 33.
FIG. 36 is a perspective view showing the added smokable filler of FIG. 35 remaining at the bottom of the interior of the first cone.
FIG. 37 is a perspective view showing the added smokable filler of FIG. 35 remaining at the bottom of the interior of the first cone, while the conical form mandrel is schematically shown as being moved longitudinally relative to the first cone to provide additional interior volume in the first cone for even more added smokable filler.
FIG. 38 is another perspective view of the first cone with conical form mandrel being filled with even more additional smokable filler from that added in FIG. 35.
FIG. 39 is a perspective view showing the even more added smokable filler of FIG. 38 remaining at the bottom of the interior of the first cone.

FIGS. 34 and 35 are perspective views showing the added smokable filler 1110 remaining at the bottom of the interior 114 of the first cone 100, while the expanding conical form mandrel 400" is schematically shown as being moved longitudinally relative to the first cone 100 to provide additional interior volume 114 in the first cone 100 for additional smokable filler to be added (schematically indicated by arrow 596). Pulling up in the direction of arrow 596 allows smaller diameter 508' of mandrel 400" to expand to diameter 508" where expansion of diameter 508" is limited by inner surface 130 of cone 100 (but at the location shown in FIG. 34 the inner surface 130 is actually spaced farther apart than the inner surface 130 shown in FIG. 33). The pulling up in the direction of arrow 596 of expanding conical form mandrel 400" also allows for tamped smokable filler to accumulate in the interior 114 of first cone 100. On the other hand, if conical form mandrel 400" was filled with smokable filler and merely pulled out of first cone 100 it is expected that the smokable filler would also be pulled out of first cone 100 when conical form mandrel 400" is pulled out.

FIG. 36 is a perspective view showing the added smokable filler 1130 remaining at the bottom of the interior 114 of first cone 100. FIG. 37 is a perspective view showing the added smokable filler 1130 remaining at the bottom of the interior 114 of the first cone 100, while the expanding conical form mandrel 400" is schematically shown as being moved longitudinally relative to the first cone 100 (schematically indicated by arrow 597) to provide additional interior volume 114 in the first cone 100 for even more added smokable filler. Pulling up in the direction of arrow 597 allows smaller diameter 508" of mandrel 400" to expand to diameter 508'" where expansion of diameter 508" is limited by inner surface 130 of cone 100 (but at the location shown in FIG. 37 the inner surface 130 is actually spaced farther apart than the inner surface 130 shown in FIG. 36).

FIG. 38 is another perspective view of the first cone 100 with expanding conical form mandrel 400" being filled with even more additional smokable filler 1140. FIG. 39 is a perspective view showing the even more added smokable filler 1130 remaining at the bottom of the interior 114 of the first cone 100.

Figures 40, 41, 42:
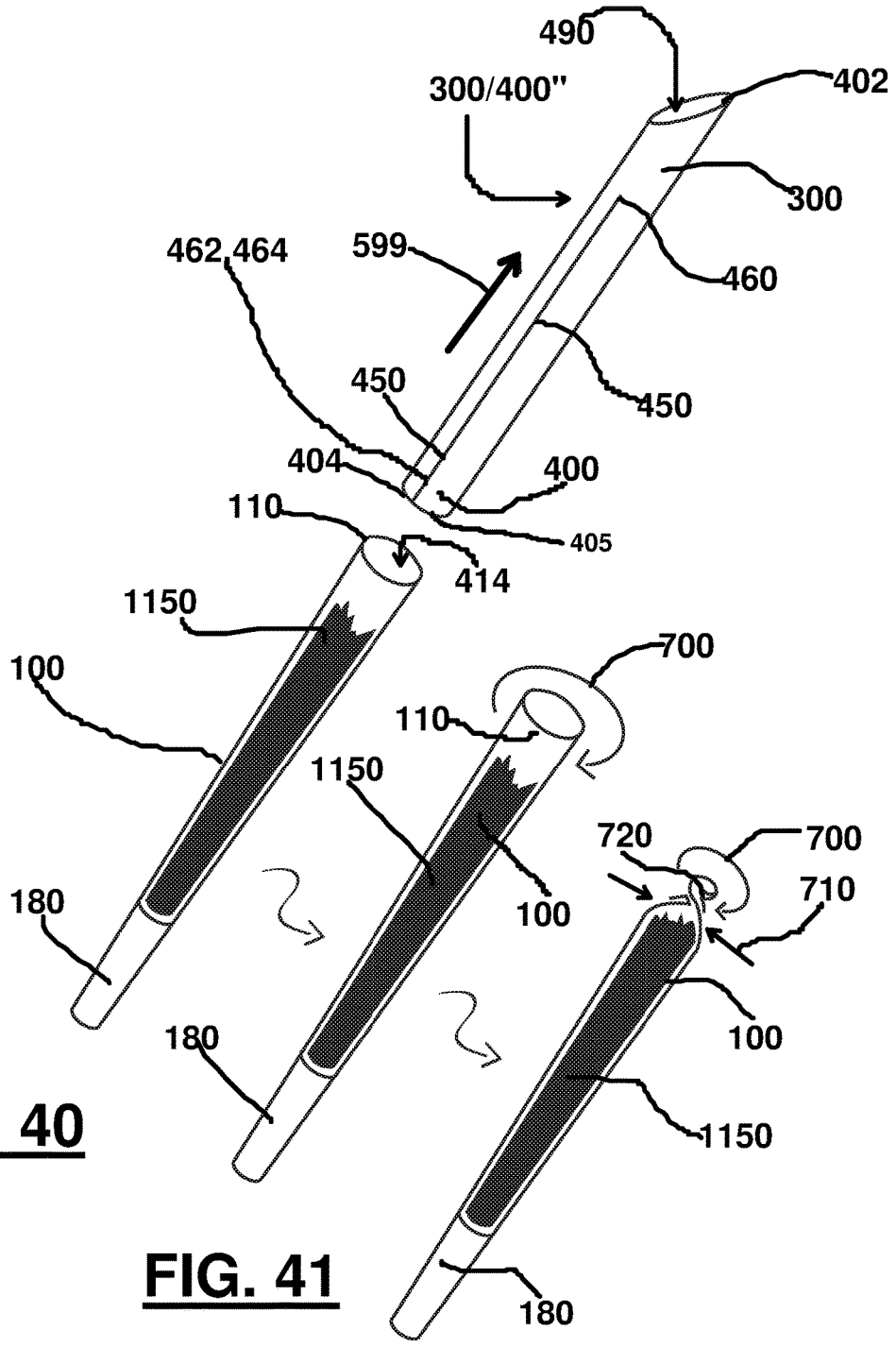
FIG. 40 is a perspective view of the first cone with conical form mandrel now completely removed from the first cone.
FIG. 41 is a perspective view of the first cone filled with smokable filler, and having the first end of the first cone pinched for closing.
FIG. 42 is a perspective view of the first cone filled with smokable filler, and having the first end of the first cone now twisted to complete a customized smokable product or cigar.

FIG. 40 is a perspective view of the first cone 100 with expanding conical form mandrel 400" now completely removed from the first cone 100. Smaller diameter 508'" has now completely expanded to its original diameter 405 before edges 462 and 464 were slid over each other to make the original smaller diameter 508 of expanding conical form mandrel 400".

At this point the interior 114 of first cone 100 is filled with enough smokable filler 1150 for first cone 100 to be finished into a smokable article 1250. FIGS. 41 and 42 summarize the steps of preparing the customized finished smoking product 1250. FIG. 41 is a perspective view of the first cone 100 filled with smokable filler 1150, and having the first end 110 twisted and for closing (schematically indicated by arrow 700). FIG. 42 is a perspective view of the first cone 100 filled with smokable filler 1150, and having the first end 110 of the first cone 100 further twisted and also pinched (schematically indicated by arrow s700 and 720) to complete a customized smokable product or cigar 1250.

The following is a Table of Reference Numerals used in this patent application:

TABLE OF REFERENCE NUMERALS:

| REFERENCE NUMBER | DESCRIPTION |
|---|---|
| 10 | smoking article |
| 100 | hollow cone |
| 110 | first end |
| 114 | interior |
| 117 | slope |
| 120 | second end |

-continued

TABLE OF REFERENCE NUMERALS:

| REFERENCE NUMBER | DESCRIPTION |
|---|---|
| 130 | inner surface |
| 140 | outer surface |
| 150 | first opening |
| 160 | second opening |
| 180 | filter |
| 300 | cylindrical blank |
| 400 | conical form mandrel |
| 402 | first end |
| 404 | second end |
| 406 | length of form mandrel |
| 408 | diameter of form mandrel |
| 409 | interior |
| 414 | upper portion |
| 415 | length of non-cut portion of form mandrel |
| 416 | lower portion |
| 417 | sloped portion |
| 420 | tapered section |
| 421 | angle of taper |
| 422 | cut to make tapered section |
| 426 | removed portion |
| 450 | slit |
| 452 | cut to make slit |
| 460 | end of slit |
| 462 | first edge |
| 464 | second edge |
| 470 | length of slit |
| 472 | endpoint |
| 490 | interior |
| 500 | adhesive |
| 508 | reduced diameter of now at least partially "conically shaped" form mandrel |
| 510 | container |
| 512 | drop |
| 520 | adhesive line |
| 530 | arrow |
| 532 | arrow |
| 540 | arrow |
| 550 | arrow |
| 590 | arrow |
| 592 | arrow |
| 594 | arrow |
| 595 | arrow |
| 596 | arrow |
| 597 | arrow |
| 598 | arrow |
| 599 | arrow |
| 600 | tape/band |
| 700 | arrow |
| 710 | arrows |
| 720 | twisted knot or pigtail |
| 800 | package/wrapper |
| 802 | arrow |
| 810 | closed end |
| 820 | open end |
| 830 | interior |
| 840 | seal |
| 1000 | hollow cone |
| 1010 | first end |
| 1014 | interior |
| 1017 | slope |
| 1020 | second end |
| 1030 | inner surface |
| 1040 | outer surface |
| 1050 | first opening |
| 1060 | second opening |
| 1080 | filter |
| 1100 | first portion of smokable material being poured |
| 1110 | first portion of smokable material passing through interior of conical form mandrel such as being pushed by a stuffer or tamper |
| 1120 | second portion of smokable material being poured |

-continued

TABLE OF REFERENCE NUMERALS:

| REFERENCE NUMBER | DESCRIPTION |
|---|---|
| 1130 | second portion of smokable material passing through interior of conical form mandrel such as being pushed by a stuffer or tamper |
| 1140 | third portion of smokable material being poured |
| 1150 | third portion of smokable material passing through interior of conical form mandrel such as being pushed by a stuffer or tamper |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A kit for creating a product for smoking tobacco and other smokable substances, comprising:

(a) a first hollow cone having
- a first hollow cone longitudinal axis,
- a first end
  - defining a larger first cone opening perimeter with diameter, and
- a second end
  - defining a smaller first cone opening perimeter with diameter,
  - whereby
    - the diameter of the larger first cone opening perimeter is greater than
    - the diameter of the smaller first cone opening perimeter,
  - whereby
    - a line spanning between the larger and smaller first cone opening perimeters
      - has a first conical slope and length; and
- a first cone interior,
  - the first cone interior being defined by a space between
    - the larger first cone opening perimeter and
    - the smaller first cone opening perimeter,
- wherein, the first hollow cone is comprised of smokable materials;

(b) a first conical support being constructed from a starting cylindrical blank, the starting cylindrical blank including:
- (i) a first circular end and a second circular end, and a length between the first and circular second ends,
- (ii) a cylindrical wall spanning between the first and second circular ends having a longitudinal axis,
- (iii) the first and second circular ends respectively having an initial first diameter and an initial second diameter, wherein the initial first diameter is substantially the same as the initial second diameter;
- (iv) a separation in the cylindrical wall, the separation spanning from the first end of the first conical support to a separation end point between the first and second circular ends, which said separation end point is located closer to the second circular end compared to the first circular end, with the separation end point being spaced apart from the second circular end, and further the separation having first and second separation edges;

(v) wherein the separation is used to reduce the size of the diameter of the first circular end compared to the diameter of the second circular end, by overlapping the first and second separation edges;

(vi) wherein the reduction of the diameter of the first circular end causing the first conical support to have a first support slope and length along a line spanning between the first circular end and said separation end point, with the first conical support having a second support slope along a line spanning between the second circular end and said separation end point, with the first support slope being greater in absolute value than the second support slope;

(c) the first conical support being placed into the first cone interior, wherein the first conical slope is about the same as the first support slope, and the first conical support tending to maintain the first hollow cone in a conical shape; and (d) the first hollow cone with the supporting first conical support being packaged for sale with the interior of the first hollow cone not being filled with a smokable filler material.

2. The kit for smoking of claim 1, wherein the first conical slope is changeable based on the extent to which the first conical support is nested inside the first hollow cone.

3. The kit for smoking of claim 2, wherein the first conical slope is decreases as the nested first conical support is pulled out of the first hollow cone.

4. The kit for smoking of claim 1, wherein the first hollow cone includes a first filter tip at the second end of the first hollow cone.

5. The kit for smoking of claim 1, wherein the first hollow cone and the first conical support are nested condition inside a package.

6. The kit for smoking of claim 5, wherein the package is a bag.

7. The kit for smoking of claim 5, wherein the package is a pouch.

8. The kit for smoking of claim 5, wherein the package is a flexible wrapper.

9. The kit for smoking of claim 5, wherein the package is rectangularly shaped.

10. The kit for smoking of claim 5, wherein the package is conically shaped.

11. The kit for smoking of claim 5, wherein the package is generally cylindrically shaped.

* * * * *